US008757791B2

(12) United States Patent
Tanaka et al.

(10) Patent No.: US 8,757,791 B2
(45) Date of Patent: Jun. 24, 2014

(54) IMAGE FORMING APPARATUS

(75) Inventors: Akiyoshi Tanaka, Kanagawa (JP); Yoichi Ito, Tokyo (JP); Kuniyori Takano, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 219 days.

(21) Appl. No.: 13/309,949

(22) Filed: Dec. 2, 2011

(65) Prior Publication Data

US 2012/0147112 A1 Jun. 14, 2012

(30) Foreign Application Priority Data

Dec. 14, 2010 (JP) ..... 2010-278219
Sep. 22, 2011 (JP) ..... 2011-207995

(51) Int. Cl.

| | |
|---|---|
| ***B41J 2/01*** | (2006.01) |
| ***B41J 29/393*** | (2006.01) |
| ***B65H 83/00*** | (2006.01) |
| ***B65H 39/10*** | (2006.01) |

(52) U.S. Cl.
USPC ..... 347/104; 347/19; 271/3.14; 271/290

(58) Field of Classification Search
None
See application file for complete search history.

(56) References Cited

U.S. PATENT DOCUMENTS

| | | | | |
|---|---|---|---|---|
| 6,890,114 | B2 * | 5/2005 | Kawaguchi | 400/641 |
| 7,623,816 | B2 | 11/2009 | Maki et al. | |
| 7,682,016 | B2 | 3/2010 | Sakuma et al. | |
| 2009/0309912 | A1 * | 12/2009 | Kusuhata | 347/16 |

FOREIGN PATENT DOCUMENTS

| | | |
|---|---|---|
| JP | 9-194107 | 7/1997 |
| JP | 9-277636 | 10/1997 |
| JP | 10-193591 | 7/1998 |
| JP | 11-199117 | 7/1999 |
| JP | 2005-263341 | 9/2005 |
| JP | 2005-350182 | 12/2005 |

OTHER PUBLICATIONS

U.S. Appl. No. 13/238,034, filed Sep. 21, 2011.
U.S. Appl. No. 13/286,426, filed Nov. 1, 2011.

* cited by examiner

*Primary Examiner* — Stephen Meier
*Assistant Examiner* — Alexander C Witkowski
(74) *Attorney, Agent, or Firm* — Cooper & Dunham LLP

(57) ABSTRACT

An image forming apparatus including an image forming device to form an ink image on a recording sheet, a discharger to discharge the sheet bearing the ink image in a face-down manner, and a stacker to stack the discharged sheet thereon. The stacker includes a first surface to deform a rear end portion of the sheet, and a second surface which has a surface to press a front end portion of the sheet and is slanting so as to rise in the sheet discharging direction. The first and second surfaces are arranged such that the first surface or an extended surface thereof intersects at an angle with the second surface or an extended surface thereof to form an intersection line and such that when the front edge of the recording sheet reaches the second surface, the rear edge of the recording sheet has not yet been discharged by the discharger.

10 Claims, 15 Drawing Sheets

| ANGLE α(° ) | AMOUNT OF CURL | STACKING PROPERTY | ANOTHER PROBLEM |
|---|---|---|---|
| 10 | LARGE | × | |
| 15 | LARGE | × | |
| 20 | LARGE | × | |
| 24 | MEDIUM | △ | |
| 25 | SMALL | ○ | |
| 30 | SMALL | ○ | |
| 35 | SMALL | ○ | |
| 40 | SMALL | ○ | |
| 45 | SMALL | ○ | |
| 46 | MEDIUM | △ | |
| 50 | LARGE | × | REAR END PORTION OF PAPER SHEET REMAINS BETWEEN PAIR OF DISCHARGING ROLLERS |

IMAGE FORMING APPARATUS

CROSS-REFERENCE TO RELATED APPLICATIONS

This patent application is based on and claims priority pursuant to 35 U.S.C. §119 to Japanese Patent Applications Nos. 2010-278219 and 2011-207995, filed on Dec. 14, 2010 and Sep. 22, 2011, respectively, in the Japan Patent Office, the entire disclosure of which is hereby incorporated herein by reference.

TECHNICAL FIELD

This disclosure relates to an image forming apparatus. Particularly, this disclosure relates to an image forming apparatus having an inkjet image forming device to form an ink image on a recording material, a discharger to discharge the recoding material bearing the image in a face-down manner, and a stacker to stack the discharged recording material thereon.

BACKGROUND

There are inkjet image forming apparatuses having an inkjet image forming device such as an inkjet recording head to eject ink droplets toward a recording material such as a paper sheet (hereinafter referred to as a recording sheet). In such inkjet image forming apparatuses, ink images on a recording material are not completely dried soon after the images are formed on the recording material. Therefore, the inkjet image forming apparatuses typically use a face-up discharging method in which a recording sheet bearing an image thereon is discharged from the image forming apparatuses in a face-up manner such that the image faces upward.

In contrast, there are inkjet image forming apparatuses using a face-down discharging method in which a recording sheet bearing an image thereon is discharged from the image forming apparatuses in a face-down manner such that the image faces downward so that the recording sheets stacked on a stacker can be collated or the layout of devices of the image forming apparatuses can be optimized.

Further, inkjet image forming apparatuses have a big problem in that when an ink image is formed on a paper sheet serving as a recording sheet, the paper sheet is curled by water included in the ink of the ink image. In this regard, it is well known that as water included in an ink image is penetrated into the paper sheet, the degree of curl of the paper sheet decreases.

However, there has been no proposal to effectively reduce curling of paper sheets to orderly stack paper sheets on a copy tray of an inkjet image forming apparatus using a face-down discharging method. Specifically, copy trays in various shapes have been proposed to orderly stack paper sheets thereon. However, even when such copy trays are used for inkjet image forming apparatuses, paper sheets having a high image area proportion such as images having a large size solid image cannot be well stacked thereon if the face-down discharging method is used for the image forming apparatuses.

Although the mechanism of curl of a paper sheet in an inkjet image forming apparatus will be described later in detail by reference to FIGS. 22-24, the surface of the paper sheet, on which ejected ink droplets are adhered, is expanded due to absorption of water included in the ink droplets. Since the paper sheet bearing an ink image thereon is discharged in a face-down manner from the main body of the image forming apparatus, the paper sheet has a U-shape curl such that both the side ends of the paper sheet are higher in level than the central portion thereof.

If the height of both the side ends of the curled paper sheet is greater than the height of a pair of discharging rollers from the bottom of the copy tray (or from the surface of the uppermost paper sheet stacked on the copy tray), a stacking problem occurs in which the curled paper sheet on the copy tray is pushed by the following recording sheet discharged by the pair of discharging rollers (and the paper sheet falls from the copy tray in the worst case), resulting deterioration of stacking quality of the paper sheets on the copy tray. Until now, there has been no proposal for a copy tray designed for inkjet image forming apparatuses using a face-down discharging method, and therefore the stacking problem is not yet solved.

In general, the above-mentioned U-shape curl of a paper sheet has a property such that the height of the curled paper sheet is greatest just after the paper sheet is discharged from a pair of discharging rollers, and the height of the curled paper sheet decreases as time elapses, i.e., as water in the ink image penetrates into the paper sheet. However, the time (hereinafter referred to as decurl time) taken for the paper sheet to have curl not higher than the height of the pair of discharging rollers is generally longer than the copy interval between discharging of the rear end of a paper sheet and start of discharging of the front end of the next paper sheet. When a method in which the copy interval is set so as to be longer than the decurl time is used, the copy speed decreases, resulting in deterioration of the usability and productivity (i.e., performance) of the image forming apparatus.

For these reasons, the inventors recognized that there is a need for an inkjet image forming apparatus which uses a face-down discharging method but does not cause the stacking problem without increasing costs and deteriorating the usability and productivity of the image forming apparatus.

SUMMARY

As an aspect of this disclosure, an image forming apparatus is provided which includes an inkjet image forming device to form an ink image on a recording sheet, a discharger to discharge the recoding sheet bearing the ink image in a face-down manner, and a stacker to stack the discharged recording sheet thereon. The stacker has a first surface to deform a rear end portion of the recording sheet, and a second surface which has a surface to press a front end portion of the recording sheet and which is slanting so as to rise in the sheet discharging feeding direction. The first and second surfaces are arranged such that the first surface or an extended surface thereof intersects at an angle with the second surface or an extended surface thereof to form a line of intersection and such that when the front edge of the recording sheet reaches the second surface, the rear edge of the recording sheet has not yet been discharged by the discharger.

The aforementioned and other aspects, features and advantages will become apparent upon consideration of the following description of the preferred embodiments taken in conjunction with the accompanying drawings.

DETAILED DESCRIPTION

Figure 1:
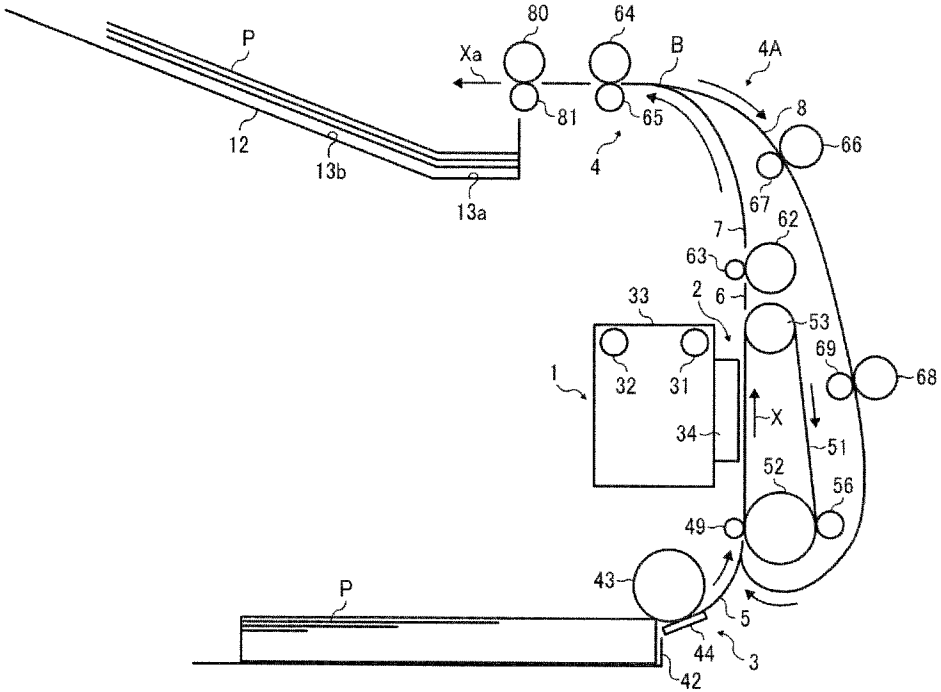
FIG. 1 is a schematic front view illustrating a first example of the image forming apparatus of this disclosure.

Several embodiments of the image forming apparatus of this disclosure will be described by reference to drawings. In the embodiments below, like reference characters designate like corresponding parts, and detailed description of a part, which is described once in detail, is omitted while attaching the same reference number thereto. In order to describe this disclosure, elements, which are to be illustrated in figures but which need not be described, are omitted from the figures.

Initially, a comparative inkjet image forming apparatus using a face-down discharging method will be described in detail.

Figure 22:
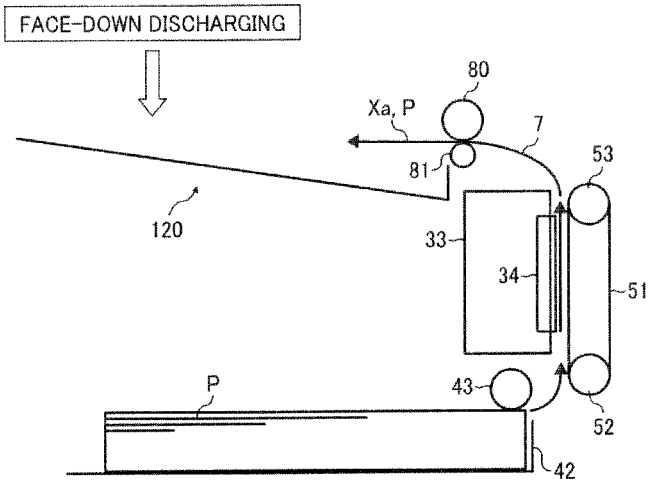
FIGS. 22 and 23 are schematic views for explaining how a stacking problem is caused by an image forming apparatus using a face-down discharging method.
Figure 23:
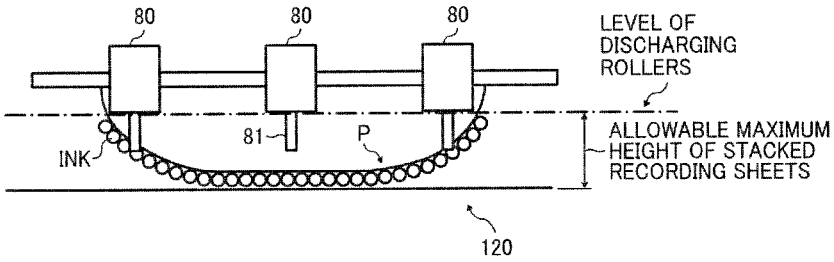

FIG. 22 illustrates a comparative inkjet image forming apparatus using a face-down discharging method, and FIG. 23 illustrates a paper sheet bearing a solid image on a lower surface thereof and discharged on a copy tray.

The inkjet image forming apparatus illustrated in FIG. 22 has a recording head 34 which is arranged so as to extend vertically, and a vertical feeding passage to vertically feed a paper sheet P, which serves as a recording material, so as to face the recording head 34. After recoding an image on the paper sheet P, the paper sheet bearing the image (hereinafter sometimes referred to simply as paper sheet) is turned by a curved feeding passage 7 so as to be discharged, thereby stacking the paper sheet on a copy tray 120 in a face-down manner.

Referring to FIG. 22, the paper sheets P stacked on a recording sheet tray 42 are fed one by one by a feeding roller 43 and a separating pad. The thus fed paper sheet P is then fed by a feeding belt 51, which is tightly stretched across a feeding roller 52 and a tension roller 53 so as to be rotated, toward an image forming area. The paper sheet P is stopped once at the image forming area, and a carriage 33 is driven so as to move in a main scanning direction (i.e., a direction perpendicular to a paper sheet on which FIG. 22 is illustrated) so that the recording head 34 is driven to eject ink droplets according to image signals to form a line of image on the stopped paper sheet P. After recording a one-line image on the paper sheet P, the paper sheet P is fed in a predetermined length by the feeding belt 51 and then stopped so that the next line of image is formed thereon by the recording head 34. By repeating this image forming operation, an image is formed on the paper sheet P. After forming an image, the paper sheet P is fed by the feeding belt 51 through the curved feeding passage 7 while separated from the feeding belt 51 by a separation pick. The paper sheet P is then discharged from the main body of the image forming apparatus by a pair of discharging rollers 80 and 81, which is rotated, in a sheet discharging direction Xa. The thus discharged paper sheet P is stacked on the copy tray 120.

In inkjet image forming apparatuses, an image is formed by ejecting ink droplets from a recording head. When ink droplets are adhered to a surface of a paper sheet, the surface of the paper sheet expands due to water included in the ink droplets, thereby curling the paper sheet so as to have a U-shape.

FIG. 23 is a schematic view illustrating behavior of one of A4 size paper sheets discharged to the copy tray 120 of the image forming apparatus illustrated in FIG. 22 when observed from a downstream side relative to the sheet discharging direction by using a video camera. In this regard, a solid image was formed on the entire surface of each of the paper sheets at a recording speed of 9 sheets per minute and the paper sheets bearing the solid image were discharged to the copy tray 120. This image forming operation was performed under low temperature and low relative humidity conditions. Since the entire lower surface of the paper sheet P, which bears the solid image thereon, expands, both the side end portions of the paper sheet P, which is discharged by the pair of discharging rollers 80 and 81, are seriously curled as illustrated in FIG. 23.

In this regard, when the amount of curl (i.e., the height of both the side ends of the curled paper sheet) is greater than the level of the pair of discharging rollers 80 and 81, the exit of the discharging rollers is obstructed by the curled paper sheet P, thereby causing the above-mentioned stacking problem. As mentioned above, conventionally proposed copy trays are not designed for image forming apparatuses using a face-down discharging method, and therefore the stacking problem is not yet solved.

Figure 24:
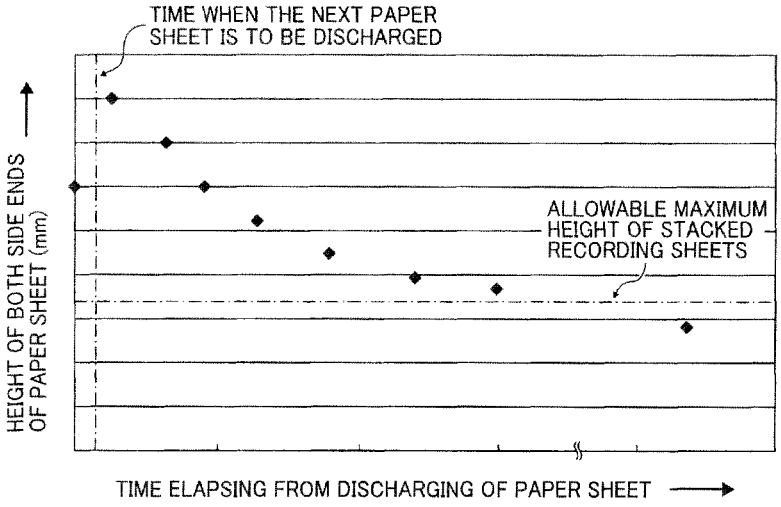
FIG. 24 is a graph showing relation between the time elapsing from discharging of a paper sheet and the height of both the side ends of the paper sheet in an image forming apparatus using a face-down discharging method.

FIG. 24 is a graph showing relation between the time (in units of seconds) elapsing from discharging of a paper sheet from the pair of discharging rollers 80 and 81 to the copy tray 120 and the maximum height (in units of mm) of both the side ends of the paper sheet. Namely, the graph illustrates change of curl of a paper sheet with time. This observation was performed under the same environmental conditions as mentioned above. It can be understood from FIG. 24, that the amount of curl increases once just after the paper sheet is discharged, but decreases thereafter with time because water in the ink adhered to the surface of the paper sheet penetrates into the paper sheet. However, the time (i.e., decurl time) needed for the paper sheet to have curl not higher than the maximum height of the stacked recording sheets is much longer than the interval between a time when a paper sheet is completely discharged to the copy tray and a time when the next paper sheet starts to be discharged from the discharging rollers 80 and 81. In this regard, the maximum height illustrated by a chain line in FIG. 23 changes depending on the structure of the copy tray 120. When a method in which the copy interval is set so as to be longer than the decurl time is used, the copy speed decreases, resulting in deterioration of the usability and productivity (i.e., performance) of the image forming apparatus.

A first example of the image forming apparatus of this disclosure will be described by reference to FIGS. 1-8.

FIG. 1 is a schematic front view illustrating an example of the inkjet image forming apparatus of this disclosure (hereinafter referred to as an image forming apparatus).

Initially, the structure of the image forming apparatus will be described by reference to FIG. 1. The image forming apparatus is a serial image forming apparatus, and has an image forming section 1 serving as an image forming device to form an image on a recording sheet using an inkjet recording method, a sheet feeding device 2 to feed the paper sheet P serving as the recording sheet so that an image is formed on a surface of the paper sheet P by the image forming section 1, a sheet supplying device 3 to supply the paper sheet P from the recording sheet tray 42 to the sheet feeding device 2, and a discharging and reversing device 4 including a discharging member to discharge the paper sheet P to a copy tray 12 serving as a stacker, and a reversing device 4A to switch back the paper sheet bearing an image on one side thereof so that another image is formed on the other side of the paper sheet P by the image forming section 1.

The sheet feeding passage of the image forming apparatus includes a sheet feeding passage 5 to feed the paper sheet P toward the sheet feeding device 2, a common passage 6 connected with the sheet feeding passage 5 to feed the paper sheet P bearing an image on one side thereof or the paper sheet P, which has been returned to the image forming section 1 while reversed by the reversing device 4A and which bears images on both sides thereof, toward a downstream side of the image forming section 1, a curved feeding passage 7 connected with the common passage 6 to feed the paper sheet P bearing an image on one side thereof or images on both sides thereof while turning the feeding direction of the paper sheet P, and a reverse feeding passage 8 connected with the curved feeding passage 7 and formed in the reversing device 4A to feed again the paper sheet P bearing an image on one side thereof toward the image forming section 1 and the sheet feeding device 2.

The image forming section 1 includes the carriage 33 capable of moving in the main scanning direction while scanning, and main and sub guide rods 31 and 32, which are arranged so as to extend in the main scanning direction to serve a guide member to slidably guide the carriage 33. The carriage 33 is connected with a main scanning motor via a timing belt so as to be allowed to make a reciprocating motion in the main scanning direction by the main scanning motor.

A recording head 34, which serves as an image recording device and which includes ink ejecting heads to eject yellow (Y), magenta (M), cyan (C) and black (K) ink droplets, is provided on the carriage 33. The recording head 34 has a configuration such that four lines of ink ejecting nozzles are arranged in a sub-scanning direction X, which is the same as the sheet feeding direction in the sheet feeding device 2 and which is perpendicular to the main scanning direction, to respectively eject Y, M, C and K ink droplets horizontally, resulting in formation of a full color image on the paper sheet P.

In addition, Y, M, C and K ink head tanks are provided in the carriage 33, and Y, M, C and K inks are supplied to the Y, M, C and K ink head tanks from Y, M, C and K ink cartridges detachably attached to the carriage 33 by respective pump units through respective ink supplying tubes.

The sheet supplying device 3 includes the recording sheet tray 42, a feeding roller 43 to feed the paper sheet P on the recording sheet tray 42, and a separating pad 44 to feed the paper sheet P while separating the paper sheet from the next paper sheet in combination with the feeding roller 43. The separating pad 44 faces the feeding roller 43 while pressed to the feeding roller, and is made of a large friction coefficient, so that the paper sheets are satisfactorily separated from each other.

The sheet feeding device 2 feeds the paper sheet P fed from the sheet supplying device 3 or the paper sheet P bearing an image on one side thereof and returned by the reversing device 4A to the image forming section 1 so that the paper sheet P faces the recording head 34. The sheet feeding device 2 includes a pressing roller 49, the feeding belt 51, and a charging roller 56.

The pressing roller 49 presses the feeding belt 51 from the front surface of the feeding belt. The feeding belt 51 electrostatically attracts the paper sheet P to feed the paper sheet to such a position as to face the recording head 34. Specifically, the feeding belt 51 serves as a feeding member to intermittently feed the paper sheet P in the sheet feeding direction X (i.e., sub-scanning direction). The feeding belt 51 is an endless belt, and is wound around a feeding roller 52 and a tension roller 53 to be circulated thereby in a belt feeding direction (i.e., the sheet feeding direction X or sub-scanning direction).

The charging roller 56 serves as a charger to charge the surface of the feeding belt 51, and is contacted with an uppermost layer (insulating layer) of the feeding belt 51 so as to be rotated while driven by the feeding belt. The feeding belt 51 is circulated in the belt feeding direction X indicated by arrows by the feeding roller 52, which is rotated by a sub-scanning motor via a timing belt serving as a driving force transmitter.

The feeding belt 51 has a single layer structure or a layered structure, and the surface thereof to be contacted with the paper sheet P or the charging roller 56 has an insulating layer made of a resin such as PET, PEI, PVDF, PC, ETFE and PTFE or an elastomer while including no electroconductive material. When the feeding belt 51 has a layered structure, the surface thereof to be contacted with the feeding roller 52 and the tension roller 53 may have an electroconductive layer including such a resin as mentioned above or an elastomer, and an electroconductive material such as carbon black.

An alternating voltage, in which a plus voltage and a negative voltage are alternately output repeatedly, is applied to the charging roller 56 by a voltage applicator to charge the feeding belt 51 such that a positively charged area having a predetermined length and a negatively charged area having a predetermined length are alternately formed on the feeding belt 51 in the feeding direction X. When the paper sheet P is fed to the thus charged feeding belt 51, the paper sheet P is electrostatically attracted by the feeding belt 51 while fed in the sub-scanning direction X by rotation of the feeding belt 51.

By moving the carriage 33 while driving the recording head 34 according to image signals under control of a controller, ink droplets are ejected by the recording head 34 toward the stopped paper sheet P, thereby forming a line of image on the paper sheet P. After the line of image is formed and then the feeding belt 51 feeds the paper sheet P in a predetermined length, the one-line image forming operation is performed again to form another line of image on the paper sheet P. By repeating the paper feeding operation and the one-line image forming operation, an image is formed on the paper sheet P. When a record end signal is input to the controller or when a signal such that the rear edge of the paper sheet P passes the recording area of the recording head 34 is input to the controller, the image recording operation is ended, and then the paper sheet P the image thereon is discharged to the copy tray 12 in a face-down manner.

The image forming apparatus includes a discharging section to discharge the paper sheet P bearing an image and separated from the feeding belt 51. The discharging section includes a feeding roller 62 and a spur 63 to feed the paper sheet P bearing an image on one side thereof to the discharging and reversing device 4. The feeding roller 62 and the spur 63 form a nip at a location on an extension of the feeding belt 51, so that the feeding roller 62 and the spur 63 do not affect the image forming operation and the accuracy (i.e., reproducibility) of recorded images. In addition, the feeding roller 62 and the spur 63 have a feeding power to an extent such that after the feeding roller 62 and the spur 63 pinch the paper sheet P, the entire paper sheet P (i.e., the paper sheet P of from the front edge to the rear edge) can be satisfactorily fed toward the curved feeding passage 7 without affecting the image forming operation and the accuracy of recorded images.

The discharging and reversing device 4 includes a pair of auxiliary discharging rollers consisting of an auxiliary discharging roller 64 and a spur 65, and a pair of discharging rollers located on a downstream side from the pair of auxiliary discharging rollers and consisting of a discharging roller 80 and a spur 81. Hereinafter, the pair of auxiliary discharging roller 64 and spur 65 is referred to as the pair of auxiliary discharging rollers 64 and 65, and the pair of discharging roller 80 and spur 81 is referred to as the pair of discharging rollers 80 and 81. The pair of discharging rollers 80 and 81 serves as a discharger to discharge the paper sheet P in a face-down manner. In this regard, each of the auxiliary discharging roller 64 and the discharging roller 80 can rotate clockwise or counterclockwise.

A copy tray 12 is provided on a downstream side from the pair of discharging rollers 80 and 81 in the sheet discharging direction Xa so that the paper sheet P discharged by the pair of discharging rollers 80 and 81 is stacked on the copy tray 12.

Next, the duplex section of the image forming apparatus used for producing duplex copies will be described.

At a bifurcation B between the curved feeding passage 7 and the reverse feeding passage 8, a swingable switch such as a separation pick is provided. The reverse feeding passage 8 has a first pair of reversing rollers including a first reversing roller 66 and a first reversing spur 67, and a second pair of reversing rollers including a second reversing roller 68 and a second reversing spur 69. When the paper sheet P bearing an image on one surface thereof is fed into the reverse feeding passage 8, the paper sheet P is further fed through the reverse feeding passage 8 by the first and second pairs of reversing rollers 66, 67, 68 and 69 so as to be fed to the nip between the feeding belt 51 and the pressing roller 49.

The auxiliary discharging roller 64 is integrally provided on a discharging roller shaft, and includes multiple roller-shaped rotating members separated from each other. The rotating members are typically made of a rubber such as EPDM rubbers. By contacting the spur 65, which is a thin plate made of a metal such as stainless steel, with the auxiliary discharging roller 64, a nip is formed therebetween, and therefore the pair of auxiliary discharging rollers 64 and 65 has a sheet feeding force. Since the pair of discharging rollers 80 and 81 has a structure similar to that of the pair of auxiliary discharging rollers 64 and 65, the pair of discharging rollers 80 and 81 also has a sheet feeding force.

The main function of the pair of discharging rollers 80 and 81 is to feed and discharge the paper sheet P to the copy tray 12 using the sheet feeding force thereof. In contrast, the function of the pair of auxiliary discharging rollers 64 and 65 is to feed and guide the paper sheet P to the pair of discharging rollers 80 and 81 while assisting the sheet feeding force of the pair of discharging rollers 80 and 81 to satisfactorily discharge the paper sheet P from the main body of the image forming apparatus.

Next, the operation of the first example of the image forming apparatus will be described by reference to FIG. 1.

Initially, a case where an image is formed on one side of a recording material will be described. When a user turns on the image forming apparatus and performs an input operation such as input of the number of copies and information on zoom or reduction, a controller of the image forming apparatus controls the sheet supplying device 3 to achieve an activated state while being synchronized with the image forming section 1 and the sheet feeding device 2. Specifically, the feeding roller 43 and the separating pad 44 cooperate to feed an uppermost sheet of the paper sheet P in the recording sheet tray 42 while separating the paper sheet from the following paper sheet, so that the paper sheet P is fed to the nip between the pressing roller 49 and the feeding belt 51 along the sheet feeding passage 5.

In this regard, since the feeding roller 52 is rotated by a sub-scanning motor, the feeding belt 51 is rotated in the sheet feeding direction (i.e., sub-scanning direction) indicated by the arrow X. In addition, since the charging roller 56, to which an alternate voltage is applied, is contacted with the uppermost layer of the feeding belt 51 and rotated while driven by the feeding belt 51, the feeding belt 51 is charged so that a positively charged strip-shaped portion and a negatively charged strip-shaped portion are alternately formed thereon. When the paper sheet P is fed to the thus charged feeding belt 51, the paper sheet P is electrostatically attracted by the feeding belt 51. Therefore, the paper sheet P is fed in the sub-scanning direction X by the feeding belt 51. In this regard, the paper sheet P is stopped once at the recording area.

Next, the carriage 33 is driven to move in the main scanning direction while the recording head 34 on the carriage 33 is driven to operate according to image signals, thereby ejecting ink droplets toward the stopped paper sheet P, resulting in formation of a one-line image on the paper sheet P. After the paper sheet P is fed in a predetermined length by the feeding belt 51 and then stopped, the next line of image is formed thereon by the recording head 34. By repeating this image forming operation, an image is formed on the paper sheet P. After forming an image, the paper sheet P is fed again by the feeding belt 51. In this regard, the paper sheet P is separated from the feeding belt 51 by a separation pick provided between the tension roller 53 and the feeding roller 62 so as to be fed to the curved feeding passage 7 by the pair of feeding roller 62 and the spur 63. The paper sheet P is further fed downstream relative to the sheet feeding direction X along the curved feeding passage 7.

The paper sheet P is then fed downstream relative to the sheet discharging direction Xa by the pair of auxiliary discharging rollers 64 and 65 and the pair of discharging rollers 80 and 81. When the controller receives record end signal or a signal input by a detector to detect the rear edge of the paper sheet, the printing operation is ended, and the paper sheet bearing an image on one side thereof is discharged in a face-down manner to the copy tray 12.

Next, a duplex printing operation will be described.

After the front end portion of the paper sheet P bearing an image on one side thereof is guided by the pair of auxiliary discharging rollers 64 and 65, and it is detected by a detector that the rear edge of the paper sheet P passes the bifurcation B between the curved feeding passage 7 and the reverse feeding passage 8, the auxiliary discharging roller 64 and the discharging roller 80 start to be reversely rotated, thereby reversely feeding the paper sheet P (i.e., the paper sheet P is switched back such that the rear edge of the paper sheet P serves as a front edge). In this regard, a swingable switch provided at the bifurcation B switches the feeding passage from the curved feeding passage 7 to the reverse feeding passage 8.

When a detector detects the front edge of the switched back paper sheet P, the paper sheet P is fed downstream in the reverse feeding passage 8.

The paper sheet P is further fed downstream in the reverse feeding passage 8 by the first pair of reversing rollers 66 and 67 and the second pair of reversing roller 68 and 69, and is fed again to the recording area of the recording head 34 while attracted by the feeding belt 51 so that another image is formed on the opposite surface of the paper sheet P by the image recording method mentioned above.

Next, the copy tray 12 will be described in detail by reference to FIGS. 1-3.

The copy tray 12 includes first and second surfaces 13*a* and 13*b* on which the paper sheet P discharged from the pair of discharging rollers 80 and 81 is stacked. The first surface 13*a* is arranged so as to be substantially horizontal, and has a function of deforming the rear end portion of the paper sheet P discharged from the pair of discharging rollers 80 and 81. The second surface 13*b* has a surface receiving the front end portion of the paper sheet P while pressing the front end portion, and is slanting so as to rise in the sheet discharging direction Xa.

The copy tray 12 also includes a vertical wall 14 connected with the first surface 13*a* on the extreme upstream side of the first surface relative to the sheet discharging direction Xa. Needless to say, the copy tray 12 has such a size as to be able to accommodate recording sheets of all sizes used for the image forming apparatus.

Figure 2:
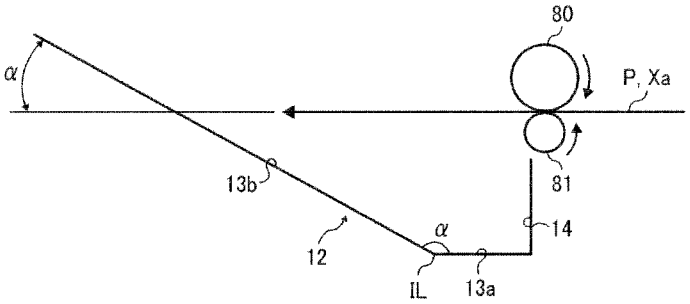
FIG. 2 is a schematic front view illustrating a pair of discharging rollers and a copy tray of the image forming apparatus illustrated in FIG. 1.

The first surface 13*a* and the second surface 13*b* of the copy tray 12 are integrated so as to intersect with each other at an obtuse angle $\alpha$ (illustrated in FIG. 2). Specifically, the first surface or the extension thereof forms a line of intersection with the second surface 13*b* or the extension thereof (in the copy tray 12 illustrated in FIGS. 2 and 3, the first and second surfaces form a line of intersection IL). In addition, the copy tray 12 has a configuration such that when the front edge of the paper sheet P reaches the second surface 13*b*, the rear end portion of the paper sheet P is still in a discharging state while nipped by the pair of discharging rollers 80 and 81 (i.e., the rear edge of the paper sheet P has not yet been discharged from the pair of discharging rollers).

Since this disclosure is characterized in the shape of the surface of the copy tray 12 receiving the paper sheet P and the sheet discharging direction Xa of the paper sheet P, which is discharged from the pair of discharging rollers 80 and 81 in a face-down manner, the first and second surfaces 13*a* and 13*b* and the like are illustrated by solid lines, and the specific shape of the copy tray 12 is not illustrated in figures. Needless to say, the copy tray 12 can have a known configuration such that the copy tray is made of a resin to reduce the weight thereof, or made of a material into which a metal plate is inserted to enhance the strength thereof.

As illustrated in FIG. 2, in the first example, the pair of discharging rollers 80 and 81 is arranged such that the sheet discharging direction Xa is substantially the same as the horizontal direction. When the paper sheet P is discharged by the pair of discharging rollers 80 and 81 from the main body of the image forming apparatus toward the copy tray 12, initially the front edge of the paper sheet P reaches the second surface 13*b* of the copy tray 12, and the front end portion of the paper sheet p is then fed along the slanting surface of the second surface 13*b* until the rear edge of the paper sheet P is completely discharged from the pair of discharging rollers 80 and 81. In this regard, just after the front end portion of the paper sheet P starts to be discharged from the pair of discharging rollers 80 and 81, both the side end portions of the front end portion of the paper sheet P curl upward (i.e., have a U-shape curl) as illustrated in FIG. 3. However, since the front end portion of the paper sheet P is nipped by the pair of discharging rollers 80 and 81, the front end portion keeps the horizontal position.

Figure 3:
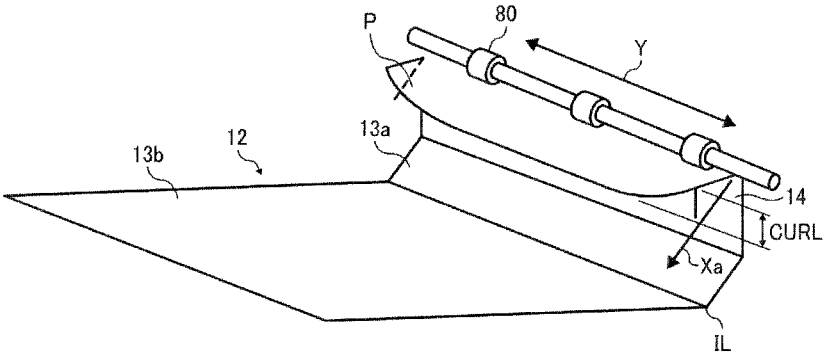
FIG. 3 is a schematic perspective view illustrating the pair of discharging rollers and the copy tray illustrated in FIG. 2.

In FIG. 3, the spur 81 is not illustrated because of being hidden by the paper sheet P. The same is true for FIGS. 4A, 4B, 5A, and 5B.

Next, a decurling operation in which the curl of the paper sheet P is remedied by the first and second surfaces 13*a* and 13*b* of the copy tray 12 will be described by reference to FIGS. 4 and 5. In the front views of FIGS. 4 and 5, the curled portion of the paper sheet P is illustrated by hatched lines.

Figure 4B:
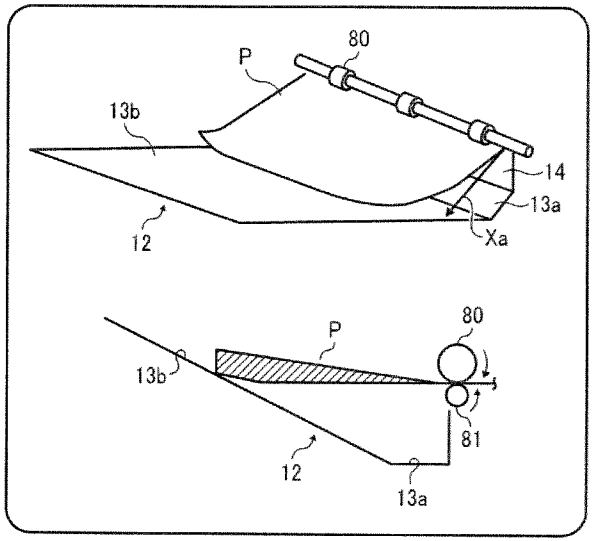
FIGS. 4A, 4B, 5A and 5B are schematic views for explaining how curl of a recording paper discharged by the pair of discharging rollers is remedied.
Figure 4A:
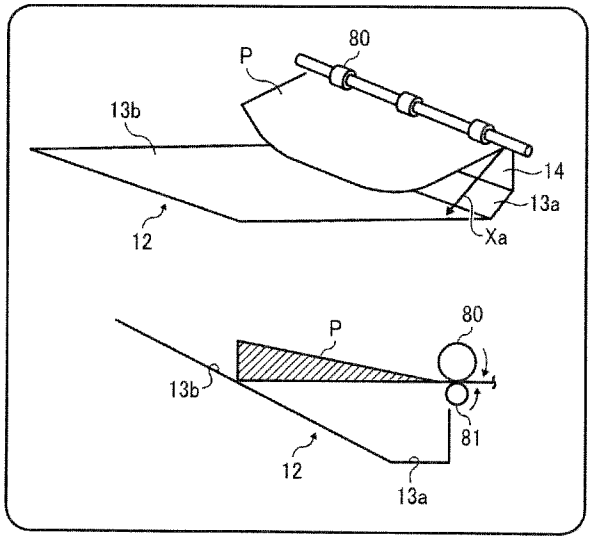

As illustrated in FIG. 4A, the height of the curled portion of the paper sheet P increases until the front edge of the paper sheet reaches a surface of the second surface 13*b* of the copy tray 12. Even after the front edge of the paper sheet P reaches the second surface 13*b*, the paper sheet P is fed forward by the pair of discharging rollers 80 and 81. In this regard, the front end portion of the paper sheet P receives such a force as to be pressed toward the second surface 13*b*. Specifically, since the second surface 13*b* is slanting so as to rise in the sheet discharging direction Xa, a force in a direction perpendicular to the sheet discharging direction Xa, i.e., a force in such a direction as to fold the paper sheet P, is applied to the curled portion of the paper sheet (this phenomenon is hereinafter referred to as formation of fold), thereby decreasing the degree of curl of the front end portion of the paper sheet P as illustrated in FIG. 4B.

Figure 5B:
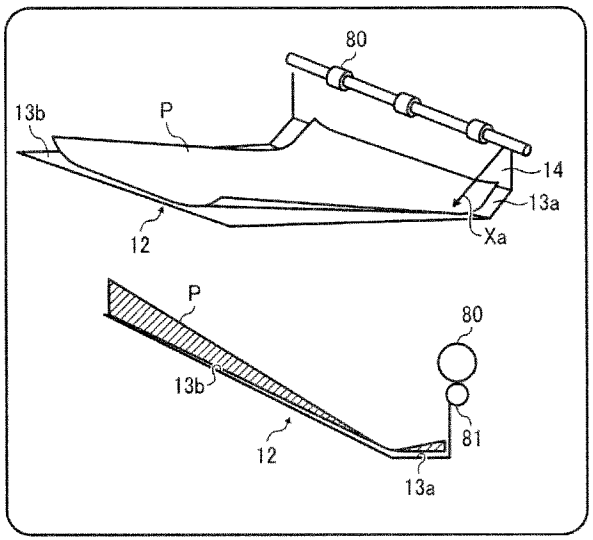
Figure 5A:
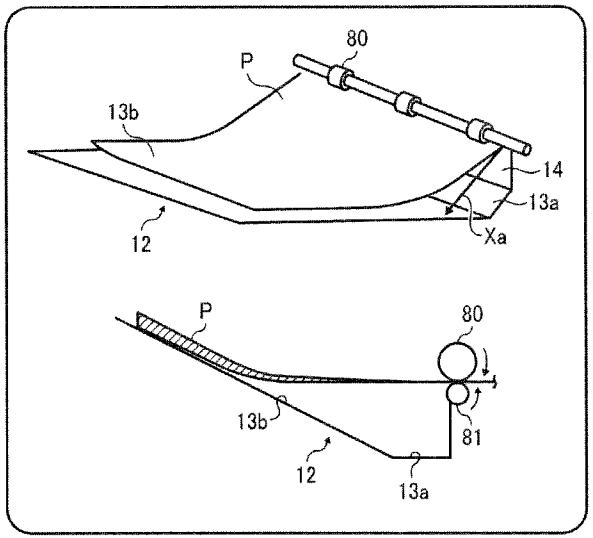

As the paper sheet P is further fed by the pair of discharging rollers 80 and 81, the degree of curl of the front end portion of the paper sheet P is further decreased due to formation of fold on a front portion of the paper sheet as illustrated by FIG. 5A. After the rear edge of the paper sheet P is perfectly discharged from the pair of discharging rollers 80 and 81, the rear end portion of the paper sheet P falls on the first surface 13*a* by gravity thereof as illustrated in FIG. 5B. In this regard, since the first and second surfaces 13*a* and 13*b* intersect with each other at the angle α, a fold is formed on the rear portion of the paper sheet P as illustrated in FIG. 5B, thereby decreasing the degree of curl of the rear end portion of the paper sheet P. In addition, since the second surface 13*b* of the copy tray 12 is slanting so as to fall toward the first surface 13*a*, the rear end portion of the paper sheet P receives the weight of the paper sheet, thereby pressing the rear end portion toward the first surface 13*a*, resulting in remedy of curl of the rear end portion of the paper sheet. Namely, since a fold is formed on the rear end portion of the paper sheet P and the rear end portion is pressed toward the first surface 13*a*, the degree of curl of the rear end portion of the paper sheet can be decreased. Thus, curl of the rear end portion of the paper sheet P can be controlled such that the height of the curled rear end portion is lower than the height of the nip between the pair of discharging rollers 80 and 81. Therefore, the following paper sheet P (copy) can be satisfactorily discharged from the pair of discharging rollers 80 and 81.

In this regard, it is important that the front edge of the paper sheet P reaches a surface of the second surface 13*b* of the copy tray 12 in the sheet discharging operation. If the rear edge of the paper sheet P is discharged from the pair of discharging rollers 80 and 81 before the front edge thereof reaches a surface of the second surface 13*b*, the entire paper sheet P is curled just after the rear edge of the paper sheet P is discharged from the pair of discharging rollers because curl of the front end portion of the paper sheet is not remedied. When the thus curled paper sheet P falls on the copy tray 12, a fold cannot be formed on the rear end portion of the paper sheet because the curled paper sheet having a U-shape is rigid, and in addition the degree of curl of the paper sheet is hardly decreased by the gravity of the paper sheet, resulting in stacking of a curled paper sheet on the copy tray 12, thereby causing the stacking problem mentioned above.

Figures 6, 7:
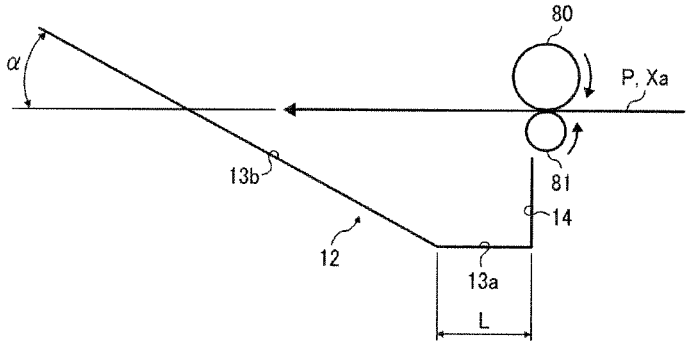
FIG. 6 is a table showing results of an experiment performed to determine the relation between the angle formed by the first and second surfaces of the copy tray, and the amount of curl and stacking property.
FIG. 7 is a schematic front view for explaining the length of the first surface of the copy tray.

FIG. 6 is a table showing results of an experiment performed to determine the relation between the angle α formed by the first and second surfaces 13*a* and 13*b* of the copy tray 12, and the amount of curl of a paper sheet and the stacking property thereof. The angle α is changed from 10° to 50°. This evaluation was performed by the method mentioned above by reference to FIGS. 22 and 23. Specifically, a solid image was formed on each of A4 size paper sheets and A5 size paper sheets at a recording speed of 9 sheets per minute under an environmental condition of low temperature and low humidity while checking the amount of curl (i.e., height) of the paper sheets and the stacking property thereof.

In FIG. 6, the mark X in the column of the stacking property represents that the stacking property of the paper sheets is bad and is on an unacceptable level, the mark Δ represents that the stacking property is slightly bad and is still on an unacceptable level, and the mark ○ represents that the stacking property of the paper sheets is good and is on an acceptable level.

It can be easily understood from FIG. 6 that the angle α formed by the first and second surfaces 13*a* and 13*b* is preferably from 25° to 45°. Namely, the following relationship (1) is preferably satisfied:

$$25° \leq \alpha \leq 45° \quad (1)$$

When the angle α is less than the preferable range, the force applied to the front end portion of the paper sheet P toward the second surface 13*b* is small when the front edge of the paper sheet reaches a surface of the second surface, thereby lessening the curl remedying effect, resulting in deterioration of the stacking property. In contrast, when the angle α is greater than the preferable range, the force needed for discharging the paper sheet P seriously increases, thereby often causing a problem in that the rear end portion of the paper sheet P remains at the nip of the pair of discharging rollers 80 and 81.

Inkjet image forming apparatuses typically uses a spur as a driven roller of a pair of discharging rollers, and the spur is arranged so as to be contacted with the surface of a recording material bearing an image thereon. This is because if a roller is used as one of a pair of discharging rollers contacting the surface of a recording material bearing an image thereon, a problem in that the printed image, which is not yet perfectly dried, is damaged by the roller, or is transferred to the roller, thereby forming a white spot image is often caused. Using a spur for one of a pair of discharging rollers prevents occurrence of the problem. In addition, the feeding force of the pair of discharging rollers is preferable as small as possible so as not to affect the sheet feeding accuracy. In this example, the pair of auxiliary discharging rollers 64 and 65 is provided to assist the pair of discharging rollers 80 and 81 such that the paper sheet P can be fed without problem through the curved feeding passage 7 by the combination of the pair of auxiliary discharging rollers 64 and 65 and the pair of discharging rollers 80 and 81.

In a tray for a paper processing device disclosed in an unexamined published Japanese patent application No. H09-194107, the second surface of the tray is arranged so as to be substantially vertical. Therefore, it is hard to discharge a paper sheet to the tray if the tray is used for an inkjet image forming apparatus (it is considered that the tray is not intended to be used for inkjet image forming apparatuses).

Figure 8:
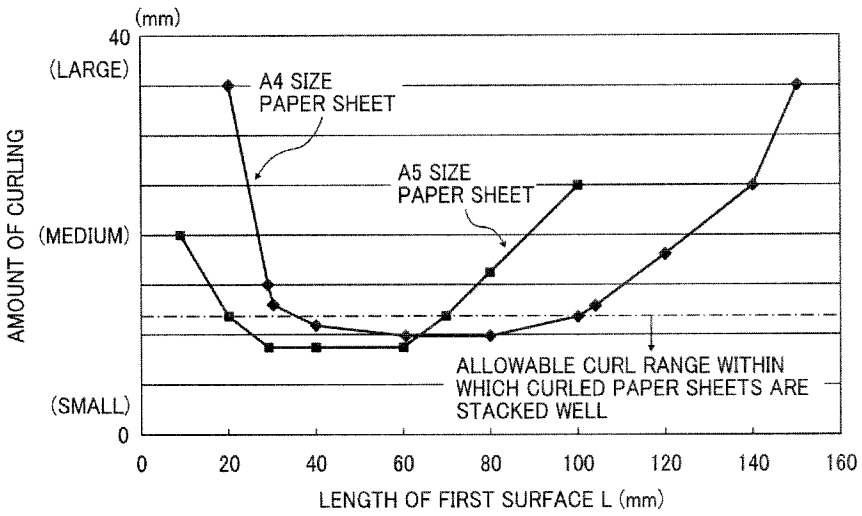
FIG. 8 is a graph showing the relation between the length of the first surface of the copy tray and the amount of curl of A4 and A5 size paper sheets.

FIG. 8 is a graph showing the relation between the length (i.e., a length L in FIG. 7) of the first surface 13*a* of the copy tray 12 and the amount of curl of A4 and A5 size paper sheets. It can be understood from FIG. 8 that in order that paper sheets P are satisfactorily stacked on the copy tray 12, the following relation (2) is preferably satisfied.

$$LS/10 \leq L \leq LS/3 \quad (2)$$

wherein LS represents the length of a paper sheet in the sheet feeding direction, and L represents the length of the first surface 13*a* in the sheet feeding direction.

Figure 9:
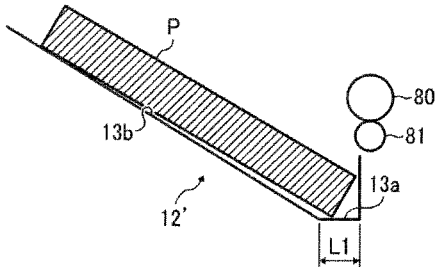
FIG. 9 is a schematic front view illustrating a comparative example of the copy tray having too short a first surface.

FIG. 9 is a schematic front view illustrating a comparative example of the copy tray 12, i.e., a copy tray 12', in which the length (i.e., a length L1 in FIG. 9) of the first surface 13*a* is shorter than the above-mentioned preferably range. In this comparative copy tray 12', no fold is formed on the rear end portion of the paper sheet P, and therefore the paper sheet is stacked on the copy tray 13' while the entire paper sheet P is curled.

Figure 10:
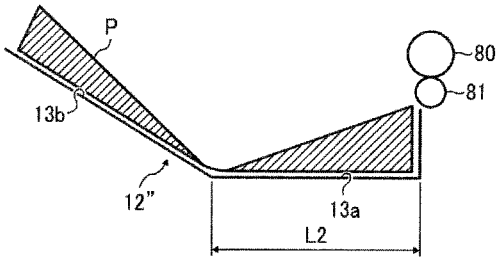
FIG. 10 is a schematic front view illustrating another comparative example of the copy tray having too long a first surface.

FIG. 10 is a schematic front view illustrating another comparative example of the copy tray 12, i.e., a copy tray 12", in which the length (i.e., a length L2 in FIG. 10) of the first surface 13*a* is longer than the above-mentioned preferably range. In this comparative copy tray 12", the rear end portion of the paper sheet P has a relatively large curl compared to the paper sheet illustrated in FIG. 5A. Therefore, this comparative copy tray produces little curl remedying effect.

When paper sheets of various sizes are used for the image forming apparatus of this disclosure, the length L of the first surface 13*a* is determined so as to fall in an overlapped range of the preferable ranges for the paper sheets of various sizes. In this regard, since curl of a paper sheet with a small size is smaller than that of a paper with a large size because the paper sheet has a narrow width, it is possible to exclude such a paper sheet from consideration when determining the length L of the first surface 13*a*.

As mentioned above, the stacking property of paper sheets on the copy tray 12 can be enhanced without complicating the structure of the copy tray, increasing costs thereof, and deteriorating the usability and productivity of the image forming apparatus.

Next, a first modified example of the image forming apparatus will be described by reference to FIG. 11.

Figure 11:
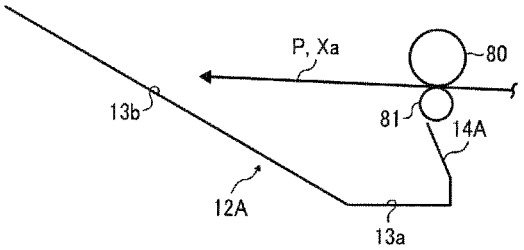
FIG. 11 is a schematic front view illustrating a modified version of the copy tray of the first example of the image forming apparatus.

As illustrated in FIG. 11, the first modified example of the image forming apparatus is the same as the example of the image forming apparatus illustrated in FIGS. 1-3 except that a copy tray 12A is used instead of the copy tray 12. Specifically, the copy tray 12A is the same as the copy tray 12 except that a slanting wall 14A is provided instead of the vertical wall 14 illustrated in FIG. 2.

The slanting wall 14A is present below the pair of discharging rollers 80 and 81 and the bottom portion thereof is connected with the first surface 13*a*. An upper portion of the slanting wall 14A is slanting in the sheet discharging direction Xa as illustrated in FIG. 11, i.e., the upper portion is projected from the end of the first surface connected with the slanting wall 14A toward an upstream side of the sheet discharging direction Xa.

In this first modified example, the paper sheet P discharged from the pair of discharging rollers 80 and 81 is pressed toward the rear end portion of the paper sheet by the slanting second surface 13*b* while the rear end portion of the paper sheet is pressed downward by the slanting wall 14A. In this regard, when the paper sheet P is curled, the degree of curl of the rear end portion of the paper sheet is further decreased because the rear end portion is pressed by the slanting portion of the slanting wall 14A along the slanting wall.

An unexamined published Japanese patent application No. H11-199117 discloses a tray similar to the first modified example. In this tray, it is necessary for a user to move paper sheets on a first portion of the tray to a second portion of the tray located below the first portion, and therefore the stacking property cannot be improved. In contrast, in this first modified example, since the rear end portion of the paper sheet P is pressed toward the slanting wall 14A by the slanting second surface 13*b* while the rear end portion is pressed downward by the slanting wall, the stacking property of the paper sheets can be improved.

Next, a second modified example of the image forming apparatus will be described by reference to FIG. 12.

Figure 12:
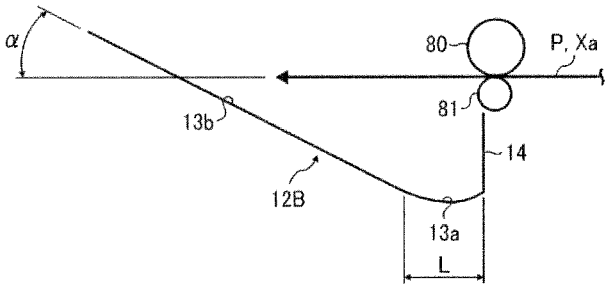
FIG. 12 is a schematic front view illustrating another modified version of the copy tray.

As illustrated in FIG. 12, the second modified example of the image forming apparatus is the same as the first example of the image forming apparatus illustrated in FIGS. 1-3 except that a copy tray 12B is used instead of the copy tray 12.

Specifically, the copy tray 12B is the same as the copy tray 12 except that the first surface 13*a* is a concave surface as illustrated in FIG. 12 whereas the first surface 13*a* of the copy tray 12 of the image forming apparatus illustrated in FIGS. 1-3 is a horizontal surface.

When the first surface 13*a* is such a concave surface as illustrated in FIG. 12 or such a flat surface as illustrated in FIG. 2, the rear end portion of the paper sheet P is pressed by the slanted second surface 13*b*, thereby producing the curl remedying effect.

Figure 13A:
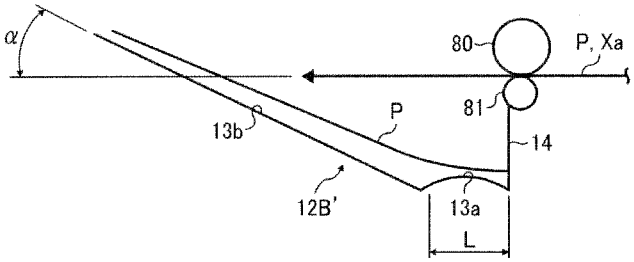
FIGS. 13A and 13B are schematic front vies illustrating a comparative example of the modified copy tray illustrated in FIG. 12.
Figure 13B:
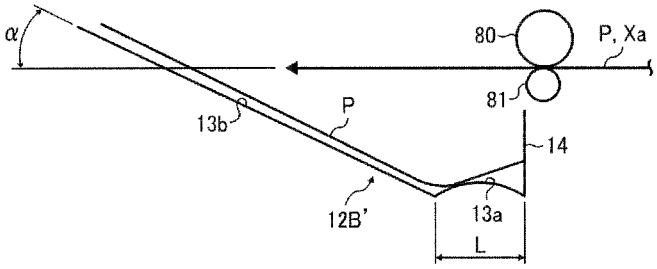

FIGS. 13A and 13B illustrate a copy tray 12B', which is a comparative example of the second modified example. The copy tray 12B' illustrated in FIGS. 13A and 13B, in which the first surface 13*a* is a convex surface, causes a problem in that the rear end portion of the paper sheet P is hardly folded (i.e., the angle of the folded portion of the paper sheet is relatively large) as illustrated in FIG. 13A, thereby hardly producing the curl remedying effect. Alternatively, the angle of the folded portion of the paper sheet becomes relatively small as illustrated in FIG. 13B, thereby raising the rear edge (i.e., increasing the height of the rear edge) of the paper sheet P. In this case, the number of paper sheets to be stacked on the copy tray 12 may decrease.

Needless to say, the modification of the second modified example can be applied to the first modified example mentioned above.

Next, a third modified example of the image forming apparatus will be described by reference to FIG. 14.

Figure 14:
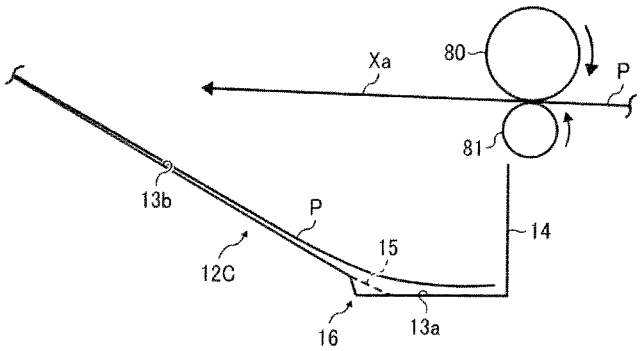
FIG. 14 is a schematic front view illustrating a yet another modified version of the copy tray.

As illustrated in FIG. 14, the third modified example of the image forming apparatus is the same as the first example of the image forming apparatus illustrated in FIGS. 1-3 except that a copy tray 12C is used instead of the copy tray 12. Specifically, the copy tray 12C is the same as the copy tray 12 except that an intersectional portion 15 (represented by a broken line) of the second surface 13*b* with the first surface 13*a* has a curvature less than that of the rear end portion of the paper sheet P, which is just discharged from the pair of discharging rollers 80 and 81, as illustrated in FIG. 14. Alternatively, the second surface 13*b* may have an intersectional portion 16 having a back clearance so that the rear end portion of the paper sheet P is not contacted therewith. In this case, the second surface 13*b* is not a continuous surface, and the extension of the second surface intersects with the first surface 13*a* to form a line of intersection.

Thus, by using a copy tray in which the intersectional portion has a curvature less than that of the rear end portion of the paper sheet P or a copy tray in which the intersectional portion has a back clearance so that the rear end portion of the paper sheet P is not contacted therewith, like the copy tray 12C illustrated in FIG. 14, good curl remedying effect can be produced. In contrast, when the intersectional portion has a curvature greater than that of the rear end portion of the paper sheet P, the curl remedying effect caused by fold of the paper sheet P is lessened, resulting in increase of curl of the paper sheet P. Needless to say, the modification of the third modified example can be applied to the first and second modified examples.

Next, a fourth modified example of the image forming apparatus will be described by reference to FIG. 15.

Figure 15:
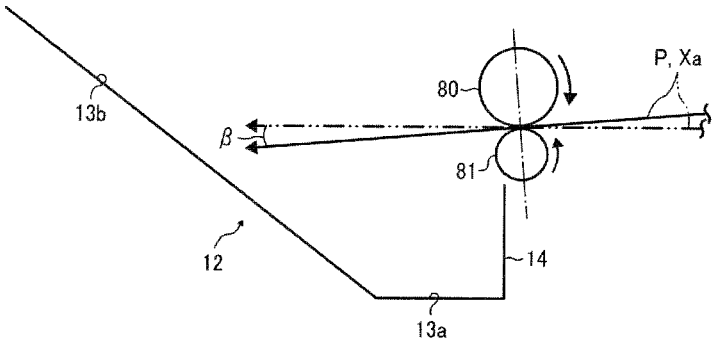
FIG. 15 is a schematic front view illustrating a modified version of the pair of discharging rollers of the first example of the image forming apparatus.

As illustrated in FIG. 15, the fourth modified example of the image forming apparatus is the same as the first example of the image forming apparatus illustrated in FIGS. 1-3 except that the sheet discharging direction Xa is slanted downward by an angle β relative to the horizontal surface. The sheet discharging direction Xa can be easily changed by changing the arrangement of the pair of discharging rollers 80 and 81 such that the line (illustrated by a chain line in FIG. 15) connecting the centers of the discharging rollers 80 and 81 is slanted relative to the vertical line. In FIG. 15, a chain double-dashed line represents the sheet discharging direction (which is the horizontal direction) in the above-mentioned first example of the image forming apparatus illustrated in FIGS. 1-3.

The sheet discharging direction is preferably the horizontal direction or a downward direction. When the sheet discharging direction is an upward direction, the angle of the rear edge of the discharged paper sheet P relative to the second surface 13*b* decreases, thereby decreasing the force pressing the paper sheet P by gravity thereof, resulting in deterioration of the curl remedying effect. In contrast, in the copy tray illustrated in FIG. 15, the force pressing the paper sheet P by gravity does not decrease, and therefore the curl remedying effect is not deteriorated.

Needless to say, the modification of the fourth modified example can be applied to the first, second and third modified examples.

Figure 16:
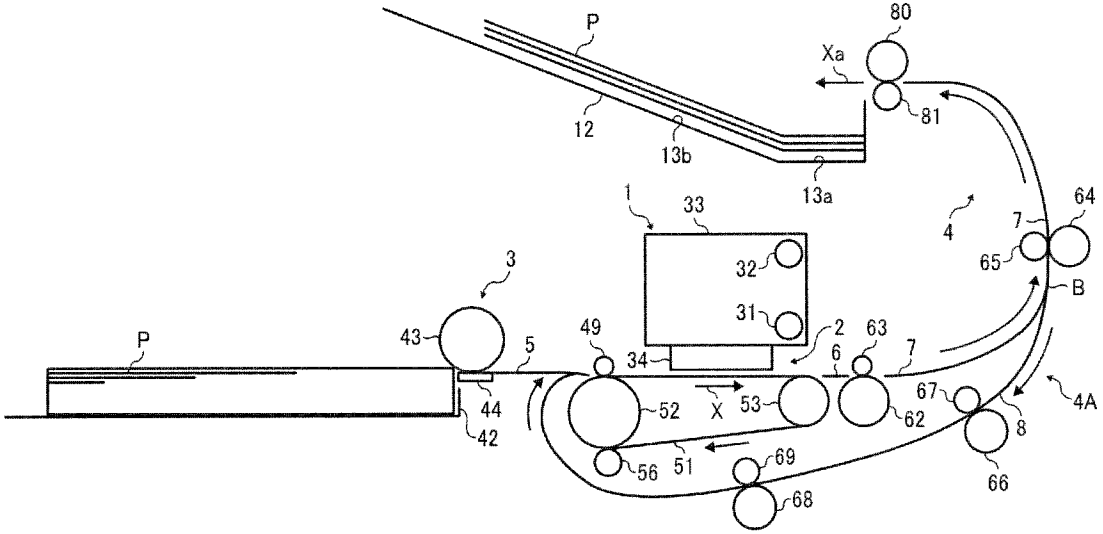
FIG. 16 is a schematic front view illustrating a modified version of the first example of the image forming apparatus.

The image forming apparatus of this disclosure is not limited to the first example mentioned above by reference to FIGS. 1-3. For example, an image forming apparatus illustrated in FIG. 16, in which the recording head 34 eject ink droplets downward in the vertical direction to form an image on the paper sheet P fed in the horizontal direction. The image forming apparatus illustrated in FIG. 16 is the same as the image forming apparatus illustrated in FIG. 1 except that the ink ejecting direction and the sheet feeding direction are different as mentioned above. Therefore, the detailed description of the image forming apparatus illustrated in FIG. 16 is omitted.

In the first example and the first to fourth modified examples mentioned above, the curl remedying effect for the paper sheet P bearing an image on one side thereof is described. When the paper sheet P bearing images on both surfaces thereof (i.e., a duplex copy) is discharged to the copy tray 12, the paper sheet P is also curled. In addition, the degree of curl is changed depending on the difference in the image area proportion between the front surface and back surface of the paper sheet P. The first example and the modified examples thereof can also be preferably used for remedying curl of a duplex copy.

In the first example and the first to fourth modified examples mentioned above, the first and second surfaces 13*a* and 13*b* are integrated. However, the first and second surfaces 13*a* and 13*b* are not limited thereto. For example, a combination such that a first surface and a second surface, which are prepared separately, are connected with each other using a connector or fastener such as a screw, a double-faced tape, and an adhesive, or are engaged with each other using a connecting member. The same is true for the connection of the first surface 13*a* with the vertical wall 14 or 14A.

Next, a second example of the image forming apparatus will be described.

It is described in the first example by reference to FIG. 6 that the angle α between the sheet discharging direction Xa and the second surface 13*b* is preferably from 25° to 45° so that the paper sheets P are satisfactorily stacked on the copy tray 12. However, the front end portion of the paper sheet P has a certain degree of curl as illustrated by hatched lines in the front view of FIG. 5B, although the curl does not affect the stacking property of the paper sheet P. The degree of curl of paper sheets changes depending on the properties of the paper sheets. When a paper sheet having a relatively large amount of curl is used, the copies stacked on the copy tray 12 have relatively large amount of curl, resulting in deterioration of the appearance of the copies.

In this second example, curl of the front end portion of the paper sheet P is reduced.

The second example of the image forming apparatus of this disclosure will be described by reference to FIGS. 17-19.

Figure 17A:
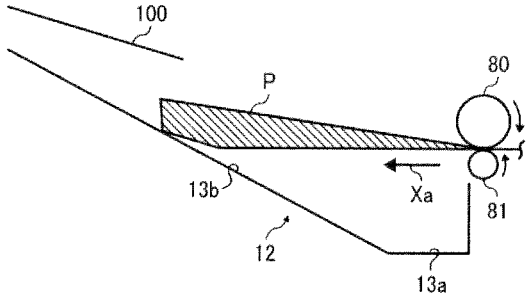
FIGS. 17A and 17B are schematic front views for explaining how a paper sheet is discharged and stacked on a copy tray of a second example of the image forming apparatus, which has a pressing member.
Figure 17B:
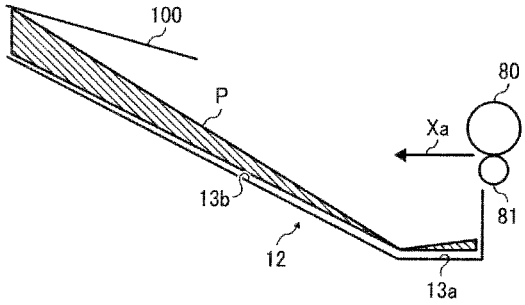

FIG. 17A illustrates the paper sheet P, which is being discharged from the pair of discharging rollers 80 and 81 to the copy tray 12 of the second example, and FIG. 17B illustrates the paper sheet P, which has been discharged by the pair of discharging rollers 80 and 81 and is stacked on the copy tray 12.

The second example is the same as the first example except that the a pressing member 100 is additionally provided above the second surface 13*b* of the copy tray 12 to press the curled side end portions of the paper sheet P. The pressing member 100 is a plate or the like, but only the lower surface thereof is illustrated in FIGS. 17A and 17B for explanation purposes.

The pressing member 100 is made of a material, which does not affect feeding of the recording sheet discharged from the discharging rollers, such as resins (such as polyesters) and metals.

There are variations in arrangement and locations of the pressing member 100. For example, it is possible that the pressing member 100 is fixed to a main body of the image forming apparatus, or is detachably attached to the main body. Alternatively, the pressing member 100 is fixed to a side wall of the copy tray 12, or is detachably attached to the side wall.

Next, the operation of the main portion of the second example will be described.

Similarly to the first example, the curl remedying operations are performed on the paper sheet P, which is being discharged by the pair of discharging rollers, and the paper sheet, which is discharged and stacked on the copy tray 12. In addition to the curl remedying operations, the pressing member 100 presses the curled portions (illustrated by hatched lines) of the side end portions of the front portion of the stacked paper sheet P. Specifically, when the paper sheet P is fed in the sheet discharging direction Xa while pressed toward the second surface 13*b* of the copy tray 12, the paper sheet is slid on the second surface 13*b* while guided and pressed by the pressing member 100, and then stacked on the copy tray 12 while pressed by the pressing member 100 as illustrated in FIG. 17B.

Figure 18:
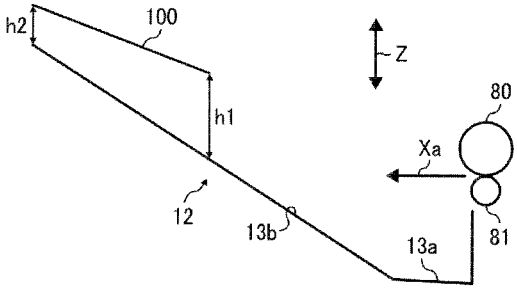
FIG. 18 is a schematic front view illustrating positional relation between the second surface of the copy tray and the pressing member in the second example of the image forming apparatus.

As illustrated in FIG. 18, the distance in a Z direction between the pressing member 100 and the second surface 13*b* decreases in the sheet discharging direction Xa, and a distance h2 between the front edge of the pressing member 100 and the front edge of the second surface 13*b* is shorter than a distance h1 between the rear edge of the pressing member 100 and the surface of the second surface 13*b* facing the rear edge of the pressing member. In this regard, the distance h1 on the rear edge side of the pressing member 100 is greater than the height of the curled front end portion of the paper sheet P so that the paper sheet P discharged by the pair of discharging rollers can be securely guided to the space formed by the pressing member 100 and the second surface 13*b*. In addition, the distance h2 is shorter than the distance h1 to decurl the front end portion of the paper sheet P.

Figure 19A:
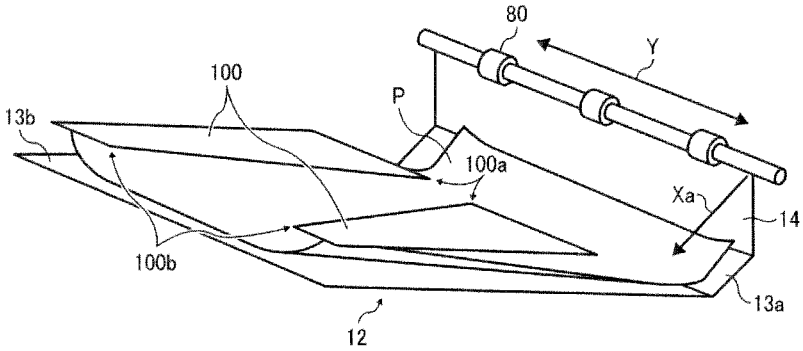
FIGS. 19A and 19B are a perspective view and a plan view illustrating the pressing member of the copy tray illustrated in FIG. 18.
Figure 19B:
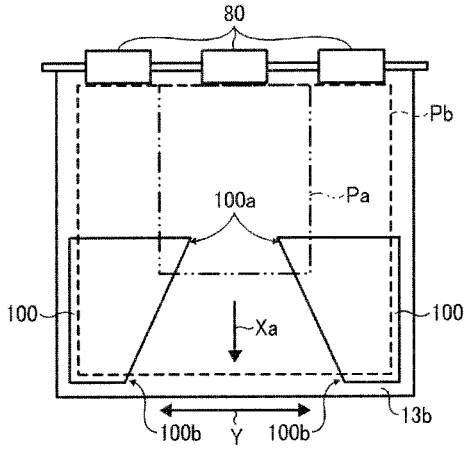

FIGS. 19A and 19B are a perspective view and a plan view illustrating the pressing member of the copy tray illustrated in FIG. 18. Since this example of the image forming apparatus is a center-feeding type image forming apparatus in which the paper sheet P is fed in a central portion of the passages of the apparatus and discharged on a central portion of the copy tray 12 even when different sizes of paper sheets Pa and Pb (illustrated in FIG. 19B) are used. As illustrated in FIGS. 19A and 19B, the pressing member 100 is provided on each side of the copy tray 12 in a width direction Y of the copy tray, and the width of each of the pressing members 100 in the direction Y is narrowed in the sheet discharging direction Xa. A wide portion 100*a* of each pressing member 100 is used for pressing the curled front end portion of the paper sheet Pa of small size, and a narrow portion 100*b* of each pressing member 100 is used for pressing the curled front end portion of the paper sheet Pb of large size.

When the paper sheet P is a paper sheet of small size, the width of each pressing member 100 has to be increased so as to be the width of the wide portion 100*a*. However, when the front end portion 100*b* of each pressing member 100 has the same width as the wide portion 100*a*, it becomes difficult to draw a copy of large size from the copy tray 12. Therefore, the pressing member 100 becomes narrow in the sheet discharging direction Xa as illustrated in FIG. 19B. The inner side edge of each pressing member 100 is linear in FIG. 19B, but the inner side edge may be stepped or concavo-convex so that the projected portions of the stepped or concavo-convex inner side edge face the front end portions of paper sheets of small sizes. By using such a pressing member, a copy of large size can be easily drawn from the copy tray 12 because the area of contact of the pressing member 100 with the copy is decreased.

The pressing member 100 used for this second example can be applied to the first to fourth modified examples as well as the first example.

By using the pressing member 100, curl of copies can be reduced.

When the image forming apparatus is not such a center-feed type image forming apparatus as illustrated in FIG. 19B and is a one-sided feed type image forming apparatus, only one pressing member having such a configuration as that of the pressing member 100 illustrated in FIG. 19B can be used.

Next, a third example will be described.

Figure 20:
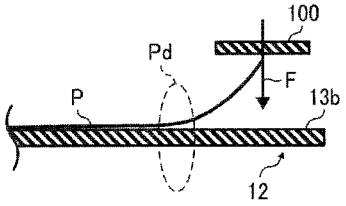
FIG. 20 is a schematic view for explaining how a force is applied to a paper sheet contacting the second surface and the pressing member of the copy tray of the second example.

When the pressing member 100 mentioned above in the second example is used, a force F in a direction indicated by an arrow is applied to the front edge of the paper sheet P by the pressing member as illustrated in FIG. 20. In this case, a contact portion Pd of the surface of the paper sheet P, which is surrounded by a dotted circle in FIG. 20 and at which the front portion of the paper sheet is separated from the second surface 13*b*, is pressed to the second surface 13*b*, and it is possible that the image on the portion Pd of the paper sheet is damaged due to friction between the paper sheet P and the second surface 13*b*. Therefore, in this third example, a spur 101 is provided so as to face the contact portion Pd as illustrated in FIGS. 21A and 21B to prevent friction between the paper sheet P and the second surface 13*b*, thereby preventing the image from being damaged by the second surface 13*b*.

The third example of the image forming apparatus of this disclosure will be described by reference to FIGS. 21A and 21B.

Figure 21A:
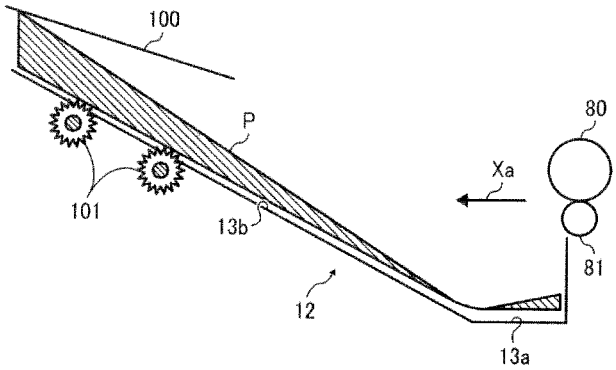
FIGS. 21A and 21B are a front view and a plan view for explaining how a paper sheet is discharged and stacked on a copy tray of a third example of the image forming apparatus, which has a rotor.
Figure 21B:
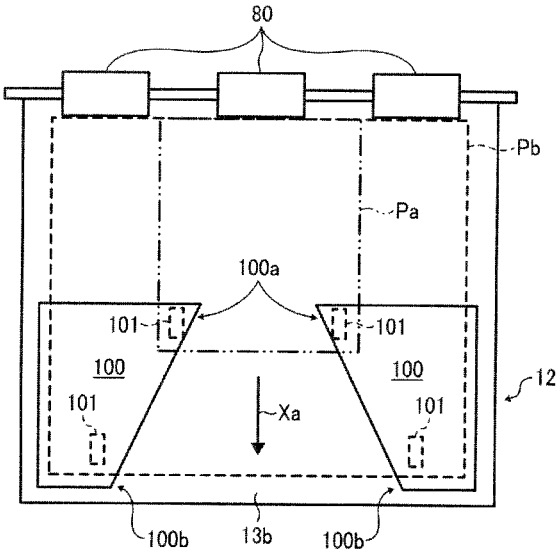

FIG. 21A is a front view illustrating the copy tray 12 of the third example, and FIG. 21B is a plan view thereof.

As illustrated in FIGS. 21A and 21B, the third example is the same as the second example except that the spurs 101 are provided on the second surface 13*b* so that the concavo-convex peripheral surfaces of the spurs 101 contact the contact portions Pd of the surface of the paper sheet P. In the copy tray 12 illustrated in FIGS. 21A and 21B, four spurs 101 are provided so as to face the front end portions of the paper sheet Pb of large size and the paper sheet Pa of small size. However, the number of the spurs 101 is not limited thereto.

The spurs 101 have a concavo-convex peripheral surface, and are freely rotated clockwise or counterclockwise while supported by the copy tray 12 via shafts.

Since the spurs 101 are provided on the copy tray of the third example, the surface of the paper sheet bearing the image thereof is not directly contacted with the second surface 13*b*, thereby preventing the image from being damaged by the second surface. In this regard, a user is not directly contacted with the spurts 101 when drawing a copy from the copy tray 12 because the spurts are provided below the pressing members 100.

The image forming apparatus of this disclosure can be used for image forming apparatuses using an inkjet recording device, such as printers, plotters, word processors, facsimiles, copiers, and multifunctional products having two or more of these functions. Further, the technology for remedying curl of a recording material in the image forming apparatus of this disclosure can be applied to other image forming apparatuses such as electrophotographic image forming apparatuses.

In the examples mentioned above, paper sheets are used as the recording material. However, other recording materials, which can be used for inkjet printing and electrophotography, can also be used as the recording material.

Additional modifications and variations of this disclosure are possible in light of the above teachings. It is therefore to be understood that within the scope of the appended claims the invention may be practiced other than as specifically described herein.

What is claimed is:

1. An image forming apparatus comprising:

an inkjet image forming device to form an ink image on a surface of a recording sheet, a discharger to discharge the recoding sheet bearing the ink image in a sheet discharging direction in a face-down manner such that the ink image faces downward, and a stacker to stack the discharged recording sheet thereon, wherein the stacker includes:

a first surface to deform a rear end portion of the recording sheet, and a second surface which has a surface to press a front end portion of the recording sheet and which is slanting so as to rise in the sheet discharging direction, wherein the first and second surfaces are arranged such that the first surface or an extended surface thereof intersects at an angle with the second surface or an extended surface thereof to form a line of intersection and such that when a front edge of the recording sheet discharged by the discharger reaches the second surface, a rear edge of the recording sheet has not yet been discharged by the discharger, and wherein an intersectional portion of the first surface and the second surface has a curvature smaller than a curvature of the rear end portion of the recording sheet just after the recording sheet is discharged from the discharger and stacked on the stacker, or a back clearance so that the rear end portion of the recording sheet is not contacted with the intersection.

2. The image forming apparatus according to claim 1, wherein the stacker further includes:

a wall located below the discharger and extending downward while being connected with the first surface at a bottom of the wall, wherein the wall is slanting in the sheet discharging direction relative to a vertical direction.

3. The image forming apparatus according to claim 1, wherein the first surface is a substantially horizontal surface or a concave surface.

4. The image forming apparatus according to claim 1, wherein the sheet discharging direction is a substantially horizontal direction or a downward direction.

5. The image forming apparatus according to claim 1, further comprising:

a pressing member located above the second surface of the stacker to press from above the recording sheet discharged by the discharger.

6. The image forming apparatus according to claim 5, wherein a width of the pressing member in a direction perpendicular to the sheet discharging direction decreases in the sheet discharging direction.

7. The image forming apparatus according to claim 5, further comprising:

a rotor located on the second surface so as to face the pressing member, wherein the rotor has a concavo-convex peripheral surface to make point contact with the surface of the recording sheet bearing the ink image thereon.

8. An image forming apparatus comprising:

an inkjet image forming device to form an ink image on a surface of a recording sheet, a discharger to discharge the recoding sheet bearing the ink image in a sheet discharging direction in a face-down manner such that the ink image faces downward, and a stacker to stack the discharged recording sheet thereon, wherein the stacker includes:

a first surface to deform a rear end portion of the recording sheet, and a second surface which has a surface to press a front end portion of the recording sheet and which is slanting so as to rise in the sheet discharging direction, wherein the first and second surfaces are arranged such that the first surface or an extended surface thereof intersects at an angle with the second surface or an extended surface thereof to form a line of intersection and such that when a front edge of the recording sheet discharged by the discharger reaches the second surface, a rear edge of the recording sheet has not yet been discharged by the discharger, and wherein an angle $\alpha$ between the sheet discharging direction and the second surface is from 25° to 45°.

9. An image forming apparatus comprising:

an inkjet image forming device to form an ink image on a surface of a recording sheet, a discharger to discharge the recoding sheet bearing the ink image in a sheet discharging direction in a face-down manner such that the ink image faces downward, and a stacker to stack the discharged recording sheet thereon, wherein the stacker includes:

a first surface to deform a rear end portion of the recording sheet, and a second surface which has a surface to press a front end portion of the recording sheet and which is slanting as to rise in the sheet discharging direction, wherein the first and second surfaces are arranged such that the first surface or an extended surface thereof intersects at an angle with the second surface or an extended surface thereof to form a line of intersection and such that when a front edge of the recording sheet discharged by the discharger reaches the second surface, a rear edge of the recording sheet has not yet been discharged by the discharger, and wherein the following relation is satisfied:

$$LS/10 \leq L \leq LS/3$$

wherein L represent a length of the first surface in the sheet discharging direction, and LS represents a length in the sheet discharging direction of any one of sheets, which can be used as the recording sheet.

10. An image forming apparatus comprising:

an inkjet image forming device to form an ink image on a surface of a recording sheet;

a discharger to discharge the recording sheet bearing the ink image in a sheet discharging direction in a face-down manner such that the ink image faces downward;

a stacker to stack the discharged recording sheet thereon, wherein the stacker includes:

a first surface to deform a rear end portion of the recording sheet, and a second surface which has a surface to press a front end portion of the recording sheet and which is slanting so as to rise in the sheet discharging direction; and a pressing member located above the second surface of the stacker to press from above the recording sheet discharged by the discharger, wherein the first and second surfaces are arranged such that the first surface or an extended surface thereof intersects at an angle with the second surface or an extended surface thereof to form a line of intersection and such that when a front edge of the recording sheet discharged by the discharger reaches the second surface, a rear edge of the recording sheet has not yet been discharged by the discharger, and wherein a distance between the second surface and the pressing member decreases in the sheet discharging direction.

* * * * *